US009255535B2

(12) United States Patent
Larsson

(10) Patent No.: US 9,255,535 B2
(45) Date of Patent: Feb. 9, 2016

(54) CONTROL OF A/F RATIO AT CUT-OUT SPEED

(75) Inventor: Mikael Larsson, Jönköping (SE)

(73) Assignee: HUSQVARNA AB, Huskvarna (SE)

( * ) Notice: Subject to any disclaimer, the term of this patent is extended or adjusted under 35 U.S.C. 154(b) by 221 days.

(21) Appl. No.: 14/001,248

(22) PCT Filed: Feb. 23, 2011

(86) PCT No.: PCT/SE2011/050207
§ 371 (c)(1),
(2), (4) Date: Aug. 23, 2013

(87) PCT Pub. No.: WO2012/115548
PCT Pub. Date: Aug. 30, 2012

(65) Prior Publication Data

US 2013/0332049 A1 Dec. 12, 2013

(51) Int. Cl.

| | |
|---|---|
| ***F02D 41/04*** | (2006.01) |
| ***F02D 31/00*** | (2006.01) |
| ***F02D 41/14*** | (2006.01) |
| ***F02P 9/00*** | (2006.01) |

(52) U.S. Cl.
CPC ..... *F02D 41/04* (2013.01); *F02D 31/007* (2013.01); *F02D 41/1497* (2013.01); *F02P 9/005* (2013.01); *F02D 31/009* (2013.01)

(58) Field of Classification Search
CPC ..... F02D 31/007; F02D 41/10; F02D 41/12; F02D 41/045; F02D 41/04
USPC ..... 123/399, 672, 675, 682, 492, 493; 701/103, 110
See application file for complete search history.

(56) References Cited

U.S. PATENT DOCUMENTS 5,345,912 A 9/1994 Svensson et al.

(Continued)

FOREIGN PATENT DOCUMENTS

| | | |
|---|---|---|
| EP | 0715686 B1 | 6/1996 |
| FR | 2739142 A1 | 3/1997 |
| WO | 2009038503 A1 | 3/2009 |

OTHER PUBLICATIONS

International Search Report and Written Opinion of PCT/SE2011/050207 mailed Nov. 14, 2011.

(Continued)

*Primary Examiner* — Hai Huynh
(74) *Attorney, Agent, or Firm* — Nelson Mullins Riley & Scarborough LLP

(57) ABSTRACT

The invention concerns a method for controlling at least one of a fuel supply and an air supply to an internal combustion engine (1), in a fuel supply section thereof, such that an A/F-ratio is adjusted automatically to a desired level. Moreover, the method is activated at a speed close to a cut-out speed threshold (52) where the engine speed will fluctuate around the threshold (52) and the method comprises the steps of:

receiving engine speed data on rotational speed from the engine (1), briefly changing the A/F ratio, comparing engine speed data that are essentially unaffected by the brief change to engine speed data that are affected by the brief change to evaluate the impact on the engine speed fluctuation resulting from the brief change, adjusting the A/F ratio in the same direction as the brief change if the engine speed data affected by the brief change indicates an increase in acceleration after combustion/s, and adjusting the A/F ratio in the opposite direction to the brief change if the engine speed data affected by the brief change indicates a decrease in acceleration after combustion/s.

14 Claims, 4 Drawing Sheets

(56) References Cited

U.S. PATENT DOCUMENTS

| | | | | |
|---|---|---|---|---|
| 5,709,193 | A * | 1/1998 | Svensson et al. | 123/333 |
| 5,809,971 | A | 9/1998 | Svensson et al. | |
| 5,992,381 | A | 11/1999 | Aubourg | |
| 8,333,174 | B2 * | 12/2012 | Carlsson et al. | 123/339.1 |

OTHER PUBLICATIONS

Chapter II International Preliminary Report on Patentability of PCT/SE2011/050207 mailed May 20, 2013.

* cited by examiner

CONTROL OF A/F RATIO AT CUT-OUT SPEED

TECHNICAL FIELD

The subject invention concerns a method and a device for controlling the supply of fuel and/or air to an internal combustion engine in its fuel supply section, such as the carburetor or the fuel-injection system, to ensure that its mixture ratio is automatically adjusted to the desired level at cut out speed range.

BACKGROUND OF THE INVENTION

In all internal combustion engines, IC engines, the air/fuel ratio is of utmost importance for the engine function. Usually the air/fuel ratio is referred to as the A/F-ratio, A and F signifying respectively air and fuel. In order to achieve a satisfactory combination of low fuel consumption, low exhaust emissions, good runability and high efficiency the A/F-ratio must be maintained within comparatively narrow limits.

The requirements that exhaust emissions from the IC engine to be kept low are becoming increasingly stricter. In the case of car engines these requirements have led to the use of exhaust catalysers and to the use of sensors and probes positioned in the car exhaust system in order to control the A/F-ratio.

However, for consumer products, such as power saws, lawn mowers, and similar products, this technology is difficult to use for mounting reasons and also for cost-efficiency and operational-safety reasons. For instance, in a power saw, a system with sensors and probes would result in increased size and weight as well as a drastic rise in costs and possibly also cause operational safety problems. Further the sensor or the probe often requires a reference having completely pure oxygen, which is a situation that it is practically impossible to achieve in some engines, for instance the motors of power saws.

Expected future legislation with respect to CO-emissions from small IC engines may make it difficult to use manually adjusted carburetors. Given the manufacturing tolerances that could be achieved in the case of carburetors it is impossible, with the use of fixed nozzles in the carburetor, to meet these legal requirements and at the same time guarantee the user good runability in all combinations of air-pressures and temperatures, different fuel qualities and so on.

EP 0 715 686 B1 describes a method of controlling the engine A/F-ratio without the use of an oxygen sensor (lambda probe). Initially, the A/F-ratio is changed briefly. This could be effected for instance by briefly throttling or stopping the fuel supply. In connection with the change, a number of engine revolution times are measured. The revolution times relate to engine rotational speeds chosen in such a manner that at least one revolution of the engine is unaffected by the change, preferably an engine rotational speed that is sufficiently early for the A/F-ratio change not having had time to affect the engine rotational speed. Further at least one forthcoming revolution of the engine is chosen in such a manner that it is affected by the brief A/F-ratio change. In this manner it becomes possible to compute a revolution-time difference caused by an A/F-ratio change. On the basis of this revolution-time difference a change, if needed, of the mixture ratio in the desired direction towards a leaner or richer mixture is made. Thus using this method an optimal mixture can be achieved by testing how the engine reacts to a leaner or richer mixture. However, the engine control method of EP 0 715 686 B1 is somewhat slow and also requires the product to be ran under a load when fine-tuning the A/F ratio. Some machines, such as bush cutters, are not usually operated under constant load and are could thus be difficult or take even longer time to fine-tune with the method of EP 0 715 686 B1.

US 20100011597 disclose a method for quickly finding an A/F ratio when free running the engine. The A/F ratio is adjusted until a desired speed interval has been reached. The algorithm finds an A/F ratio on the rich side of the A/F curve, i.e. it seeks a decent A/F ratio which later can be optimized using e.g. under load as described in the method of EP 0 715 686 B1. However, it is sometimes desirable to find an optimal A/F ratio also when not being able to adjust under a load.

OBJECTS OF THE INVENTION

The purpose of the subject invention is to considerably reduce the problems outlined above by providing a method and a device for controlling the fuel and/or air supply to an internal combustion engine in the fuel supply section thereof, such as the carburetor or fuel injection system, that can adjust the A/F ratio at cut out speeds. This purpose is achieved without the use of an oxygen sensor (lambda probe).

SUMMARY OF THE INVENTION

At least one of the objects and/or problems discussed initially is solved by a method for controlling at least one of a fuel supply and an air supply to an internal combustion engine, in a fuel supply section thereof, such that an A/F-ratio is adjusted automatically to a desired level, the method is activated at a speed close to a cut-out speed threshold, the method comprising the steps of:

- receiving engine speed data on rotational speed from the engine,
- briefly changing the A/F ratio,
- comparing engine speed data that are essentially unaffected by the brief change to engine speed data that are affected by the brief change to evaluate the impact on the engine speed fluctuation resulting from the brief change,
- adjusting the A/F ratio in the same direction as the brief change if the engine speed data affected by the brief change indicates a increase in acceleration after combustion/s, and
- adjusting the A/F ratio in the opposite direction to the brief change if the engine speed data affected by the brief change indicates a decrease in acceleration after combustion/s.

Thereby a desired A/F ratio can quickly be found while the engine is operating at cut out speed.

DESCRIPTION OF THE INVENTION

Figure 1:
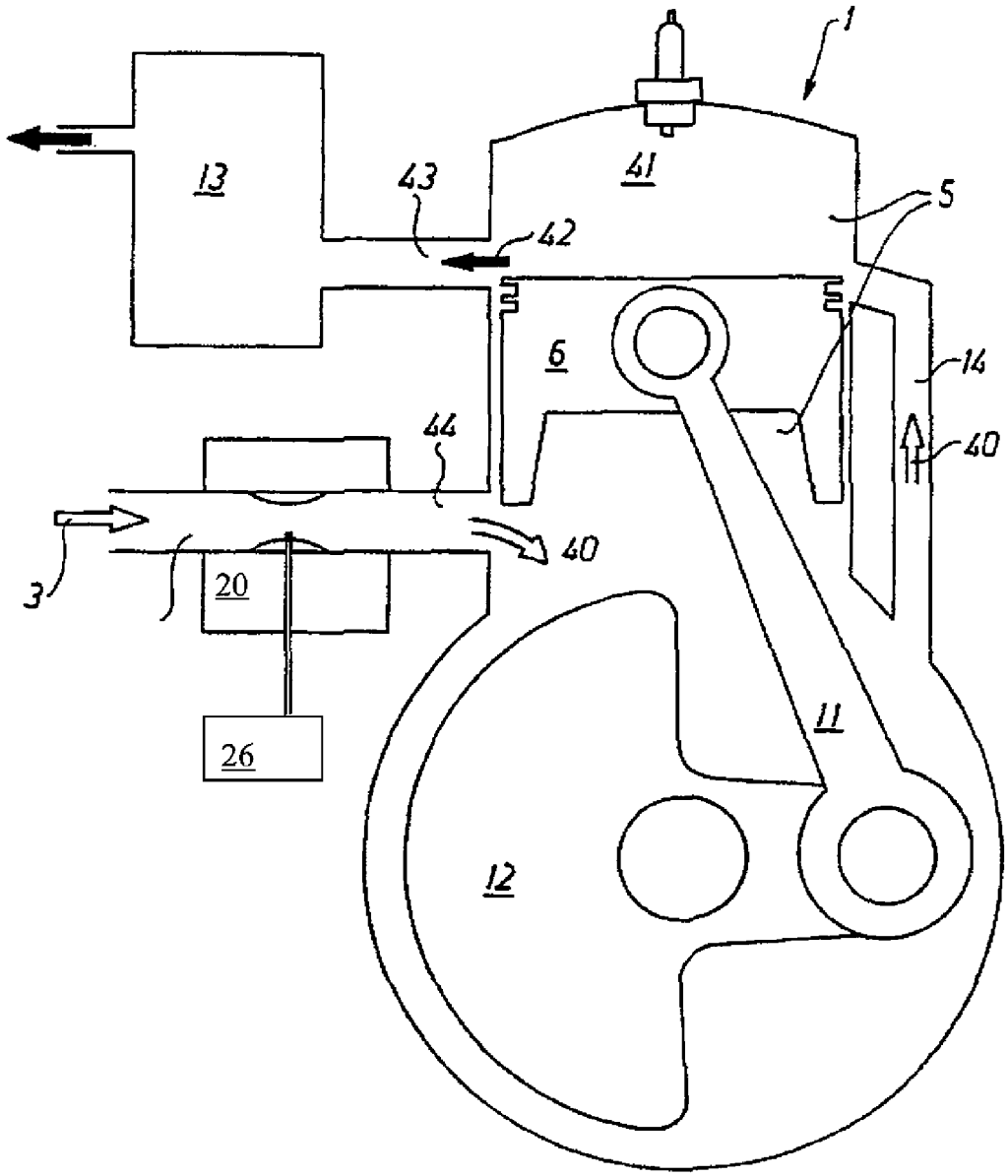
FIG. 1 shows schematically an engine connected to a fuel supply system.

In the schematically illustrated drawing FIG. 1 numeral reference 1 designates an internal combustion engine of a two-stroke type. It is crank case scavenged, i.e. a mixture 40 of air 3 and fuel from a fuel supply system 20 (e.g. a carburetor or a low pressure fuel injection system) is drawn to the engine crank house. From the crank house, the mixture is carried through one or several scavenging passages 14 up to the engine combustion chamber 41. The chamber is provided with a spark plug igniting the compressed air-fuel mixture. Exhausts 42 exit through the exhaust port 43 and through a silencer 13. All these features are entirely conventional in an internal combustion engine and for this reason will not be described herein in any closer detail. The engine has a piston 6 which by means of a connecting rod 11 is attached to a crank portion 12 equipped with a counter weight. In this manner the crank shaft is turned around. In FIG. 1 a piston 6 assumes an intermediate position wherein flow is possible both through the intake port 44, the exhaust port 43 and through the scavenging passage 14. The mouth of the intake passage 21 into the cylinder 5 is called intake port 44. Thus the intake passage 21 is closed by the piston 6. By opening and closing the intake passage 21 varying flow speeds and pressures are created inside the passage. These variations largely affect the amount of fuel supplied when the fuel supply system 10 is of carburetor type. Since a carburetor has an insignificant fuel feed pressure, the amount of its fuel feed is entirely affected by pressure changes in the intake passage 21. The subject invention makes use of these fuel amount variations in order to create simple and safe control of the amount of fuel supplied. The supplied amounts of fuel are essentially affected by the varying flow speeds and pressures inside the intake passage 21 that are caused by the opening and the closing of the latter. And further, since the crank case in crank case scavenged two-stroke engines or crank case scavenged four-stroke engines can hold a considerable amount of fuel and consequently serve as a leveling reservoir, it is not necessary to adjust the fuel supply for each revolution, i.e. adjusting the fuel supply in one revolution will affect subsequent revolutions.

Figure 2:
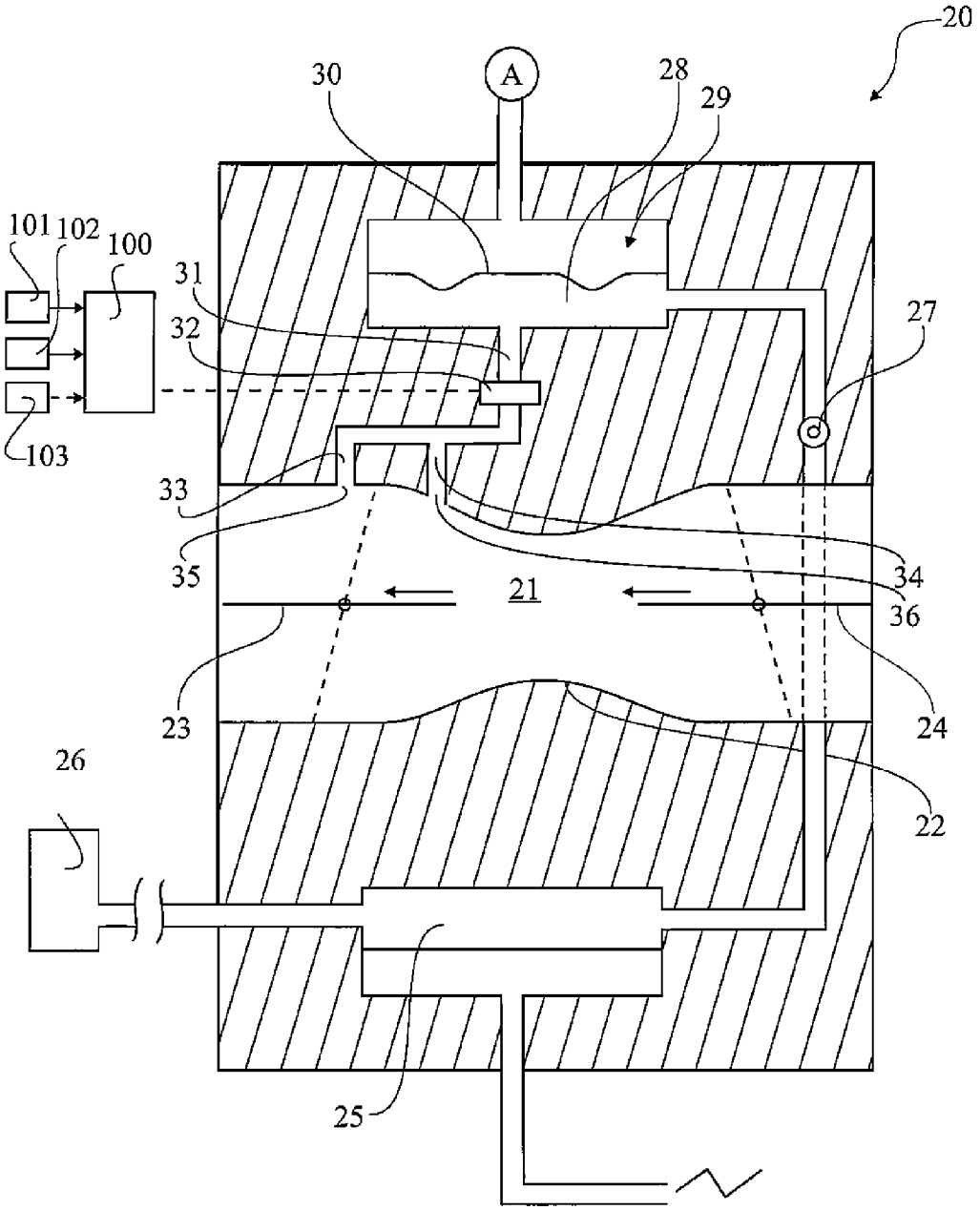
FIG. 2 shows schematically a fuel supply system in the form of a membrane carburetor.

FIG. 2 illustrates a fuel supply system 20 of carburetor type in accordance with the invention. The carburetor 20 has an intake passage 21 with a venturi 22. A throttle valve 23 and a choke valve 24 are mounted in the intake passage 21. The carburetor further includes a fuel pump 25 which draws fuel from a fuel tank 26. The fuel pump 25 is preferably a pulsation controlled diaphragm pump, driven by the pressure pulse generated by a crankcase of the engine. The fuel pump 25 delivers fuel, via a needle valve 27, to a fuel metering chamber 28 of a fuel regulator 29.

The fuel metering chamber 28 is separated from atmospheric pressure by a diaphragm 30 and can hold a predetermined amount of fuel. A duct 31, from fuel metering chamber 28, leads to a fuel valve 32. The fuel valve 32 is preferably a bistable valve, operating between two positions, open and closed. An example of such valve is shown in WO2009116902. The fuel valve 32 opens or closes the interconnection between the fuel metering chamber 28 and the fuel lines 33, 34, leading to the intake passage 21. The finer channel 33 leads to an idle nozzle 35 downstream the throttle valve 23 and the coarser channel 34 leads to a main nozzle 36 upstream the throttle valve 23. Due to the varying pressures in the intake passage 21 as the engine operates fuel is drawn from the fuel metering chamber 28 through the main nozzle 36 and the idle nozzle 35; of course when the fuel valve 32 is closed fuel is prevented from being drawn from the fuel metering chamber 28. When the throttle valve is closed fuel is drawn from the idling nozzle 35 and when the throttle valve 23 is fully open, fuel is drawn from both the idling nozzle 35 and the main nozzle 36, however since the coarser fuel line 34 to the main nozzle 36 is substantially larger than the finer fuel line 33 to the idling nozzle 35, the idling nozzle 35 hardly affects the fuel supply during full throttle.

The fuel valve 32 is controlled by an electronic control unit 100. The control unit 100 receives sensor inputs such as; throttle position from a throttle positions sensor(s) 101, engine speed data from an engine speed sensor(s) 102, and optionally inputs from additional sensor(s) 103 e.g. a temperature sensor(s). The electronic control unit 100 can use the sensor inputs to control the A/F ratio, e.g. decide when to open or close the fuel valve 32.

Engine speed data can be obtained in many different ways. Commonly a flywheel which rotates with the same speed as the engine crank has one or several magnets on its periphery, which can be used for providing energy to the ignition system as well as to other electronic components such as the engine control unit 100, but also for monitoring the engine speed by having a engine speed sensor 102 comprising a stationary detection unit arranged to detect each time a magnet of the flywheel passes the detection unit. The accuracy of the engine speed sensor 102 is dependent on the number of magnets on the flywheel and the number of detection units. For instance by using one magnet and one detection unit the time it takes for a full rotation can be measured, and by using two magnets and one detection circuit the time it takes for a half rotation of the fly wheel can be measured. If the engine speed is to be measured more frequently the number of magnets and/or detection units can be increased. Of course other means of providing engine speed data could be used within the scope of the invention.

The fuel supply is controlled by closing the fuel valve 32, i.e. shutting off the fuel supply, during a number $N_S$ of evenly distributed revolutions, utilizing the leveling characteristic of the crank case. The fuel valve 32 is preferably closed during the entire intake cycle for those revolutions it is closed, and for those revolutions it is open it is preferably fully open during the entire intake cycle. This control, which is described in more detail in US 2009145399, is performed in consecutive periods of revolutions each period having a fuel valve control sequence $N_S$/PL that determines the number $N_S$ of shut-offs for a period of PL revolutions. A first period is followed by a second period, which is followed by a third period and so on; each period having a corresponding fuel valve control sequence $N_S$/PL, a typical period length is 256 shuts offs are evenly distributed during the period. This shut-offs are evenly distributed over the period length, e.g. at 128/256 the fuel supply is shut-off every second revolution. To provide a test pulse the fuel supply may be shut off for a number of consecutive revolutions, e.g. 4-20 revolutions. Such a test pulse is referred to as brief change of the A/F ratio in the present application. Of course, the test pulse could also be implemented by changing the air supply and/or by providing an extra supply of fuel.

The present invention relates to engines which has a speed limitation implemented, where the speed limitation is implemented by skipping ignition if the engine speed exceeds a cut out speed threshold. The ignition is reinstated when the engine speed comes below the cut out speed threshold. The cut-out speed threshold can be set dynamically, i.e. it doesn't need to be a fixed value. The methods suggested below are efficient for controlling the A/F ratio at cut out speed and are thus preferably activated when the engine speed exceeds a predetermined threshold close to the cut out speed threshold.

The cut-out speed threshold will normally only be reached when an operator runs the engine at full throttle without any load. The speed will then toggle/fluctuate around the cut out speed threshold. In the present application this fluctuation is called hysteresis around the cut out speed. The hysteresis around the cut out speed threshold is dependent on the A/F ratio. Directly after combustion the engine speed acceleration will be larger if the A/F ratio is more power optimal. The increased acceleration is e.g. manifested by an increased period length and an increased amplitude length.

Figure 3:
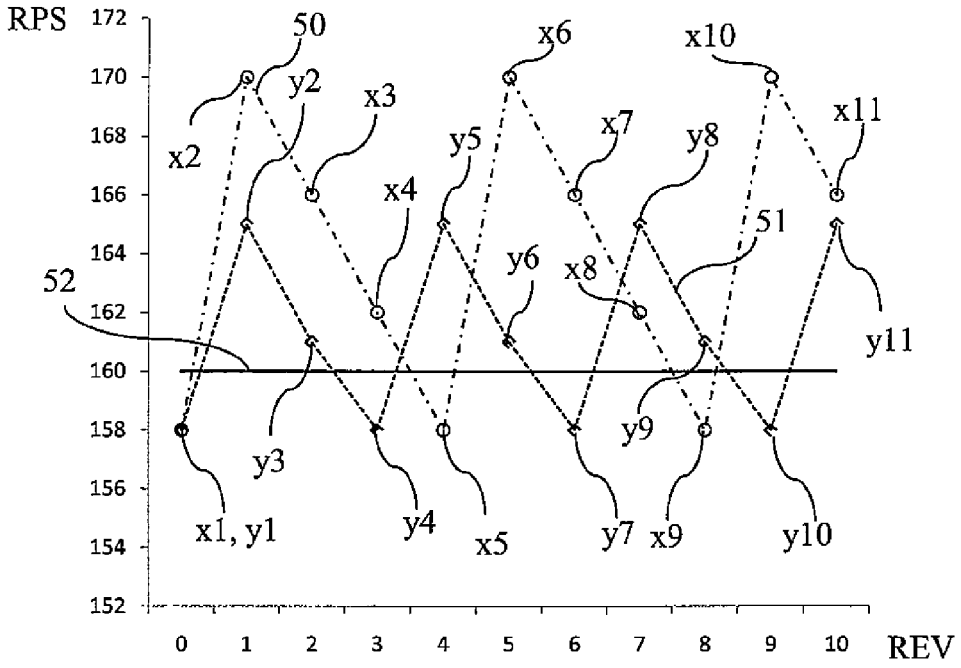
FIG. 3 shows two curves on how the engine speed can vary around at cut out speed at two different A/F ratios.

The data sets 50, 51 in FIG. 3 exemplify how the speed can fluctuate at different A/F ratios. The measuring points x1 . . . x10 correspond to a first set 50 and the measuring points y1 . . . y10 corresponds to a second data set. The first set 50 correspond to A/F ratio that provides a larger acceleration after combustions than the second set 51. As can be seen the amplitude is higher and the period length is longer for the first set 50 compared to the second set 51. The line 52 shows the cut out speed threshold. Above the cut out speed threshold ignitions the engine will not try to ignite. Thus, here the combustions have occurred close to x1, x5, and x9 for the first set 50 and close to y1, y4, y7, and y10 for the second set.

Figure 4:
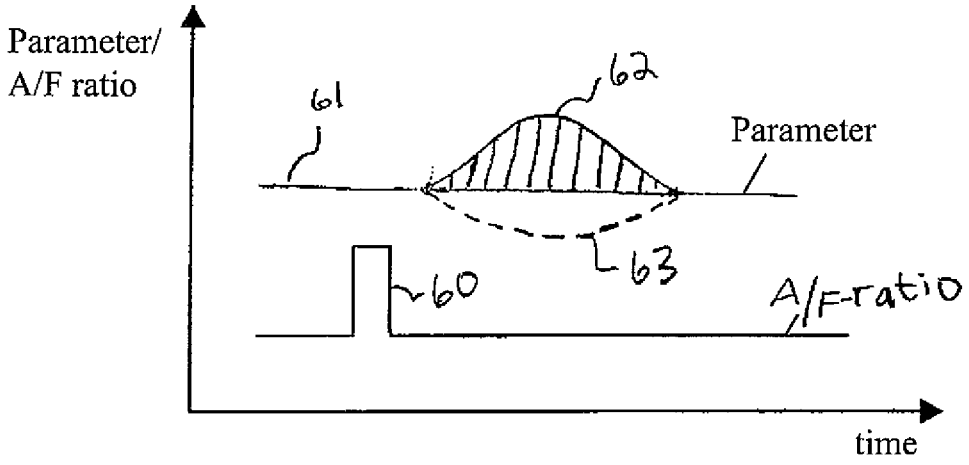
FIG. 4 shows in a simplified manner the temporary effect on a parameter depending on the engine speed hysteresis around the cut-out speed due to a brief change of the A/F ratio.

As discussed above, when making a brief change of the A/F ratio the engine speed amplitude and the engine speed period length will temporally increase or decrease, depending on if the change leads to a more power optimal setting or a less power optimal setting. E.g. the hysteresis of engine speed will make a brief shift towards longer period lengths and higher amplitudes if the change was in a direction that provided a more power optimal A/F ratio, and thereafter it will return to the same period length/amplitude as before the brief change. FIG. 4 illustrates the effect on a parameter 61 that is affected by the brief change 60. As can be seen the effect of the brief change is a temporary increase 62 in the parameter curve 61 (of course in reality the curve will not be as smooth as in this example). The dotted line represents a temporary decrease 63 in the parameter curve 61. By summing up the temporary increase or decrease of at least one parameter that is affected by the brief change 60 during a predetermined time period or predetermined number of revolutions after the brief change of the A/F ratio, a decision can be taken whether to change the A/F ratio or not—direction depending on whether the sum is negative or positive.

Thus the A/F ratio around cut-out speed can be controlled by a method comprising the steps of:

- receiving engine speed data on rotational speed from the engine,
- briefly changing the A/F ratio,
- comparing engine speed data that are essentially unaffected by the brief change to engine speed data that are affected by the brief change to evaluate the impact on the engine speed fluctuation resulting from the brief change,
- adjusting the A/F ratio in the same direction as the brief change if the engine speed data affected by the brief change indicates a increase in acceleration after combustion/s, and
- adjusting the A/F ratio in the opposite direction to the brief change if the engine speed data affected by the brief change indicates a decrease in acceleration after combustion/s.

With engine speed data affect by the brief change we here mean engine speed data where the effect from the brief change should manifest. I.e. the engine speed data that are affected by the brief change should preferably cover the main portion of any temporary increase/decrease due to the brief change. This can e.g. be done by collecting data during predetermined time period or number of revolutions after the brief change. The reference data (i.e. engine speed data that are essentially unaffected by the brief change) should be taken from engine speed data before and/or after the engine speed data that are affected by the brief change. By taking the reference data before and after the "affected data" any trend in the parameter can be compensated for.

In one embodiment, a first and a second portion of engine speed data that are essentially unaffected by the brief change are taken before (first portion) and after (second portion) the effect from the brief change should manifest, while an intermediate portion of data that includes engine speed data that are affected by the brief change are taken from a time period between the first and the second portion. The first and the last portion are used to determine an unaffected value (i.e. function as reference data) of at least one parameter that is dependent on accelerations after combustions, and the intermediate portion is used to determine at least one affected value of said parameter/s.

The parameter/s can e.g. be the period length, the amplitude of the engine speed around the cut out speed threshold or the rate of acceleration after combustion. The impact on the engine speed fluctuation from the brief change can be determined by subtracting the unaffected value from each affected value/s and calculating the sum of the resulting values/s. If said sum is positive the A/F ratio is adjusted in the same direction as the brief change, and if said sum is negative the A/F ratio is adjusted in the opposite direction as the brief change.

For instance, by providing a brief change of the A/F ratio the impact on the period length can be studied to determine whether to increase, decrease or keep the current A/F ratio. If the period length temporally increases after the brief change of A/F ratio (e.g. within predetermined time period from the brief change), the A/F ratio is preferably changed in the same direction as the brief change. Of course if the period length decreases, the A/F ratio is preferably be changed in the opposite direction.

One way of estimating the period length or part of it, is to determine the number of consecutive measuring points above the cut out speed threshold 52. For example, the first curve 50 in FIG. 3 shows three consecutive measuring points above the cut out speed threshold (x2, x3, x4; x6, x7, x8; x10, x11, . . . ) for each period, and the second curve 51 shows two consecutive measuring points above the cut out speed threshold (y2, y3; y5, y6; y8, y9; y11, . . . ) for each period.

The amplitude changes can also be used. By providing a brief change of the A/F ratio the impact on the amplitude after the brief change can be studied to determine whether to increase, decrease or keep the current A/F ratio. If the amplitude temporally increases after the brief change of A/F ratio (e.g. within predetermined time period from the brief change), the A/F ratio is preferably changed in the same direction as the brief change. Of course if the estimated amplitude decreases, the A/F ratio is preferably changed in the opposite direction.

The amplitudes can e.g. be estimated by subtracting the lowest values (x1, x5, x9; y1, y4, y7, y10) from the highest measured speeds (x2, x6, x10; y2, y5, y8, y11) or a part of the amplitude by subtracting the cut out speed threshold 52 from the highest measured speeds (x2, x6, x10; y2, y5, y8, y11). E.g. in FIG. 3, comparing the highest and the lowest values, the amplitude can be estimated to 12 for the first curve 50 and 7 for the second curve 51. To exemplify, if the hysteresis corresponds to curve 51 and a brief change is done that provides a more power optimal setting the hysteresis could move from the shape of curve 51 towards the shape of curve 50 and then return to the shape of curve 51. Thus shifting from the second curve to the first curve and back, could e.g. provide the amplitude series: 7, 8, 9, 10, 11, 10, 9, 8, 7, 7. As can be seen, even if the first and last portions (i.e. the engine speed data that are essentially unaffected by the brief change) was calculated by using the three first (7, 8, 9) and three last values (8,7,7) of the series, the impact could be detected, as long as the intermediate portion (10, 11, 10, 9) covers the main effect of the brief change. I.e. the essentially unaffected engine speed data can include data that has been slightly affected by the brief change as long as the data chosen as the engine speed data affected by the brief change covers the main affect of the brief change.

Another option is to directly study the positive accelerations of the engine speed, i.e. the positive engine speed change divided by the time it took for that speed change. E.g. looking at FIG. 3 x2−x1/(time for revolution 0-1), x6−x5/(time for revolution 4-5), and x10−x9/(time for revolution 8-9) would be the positive accelerations for the first curve 50, and y2−y1/(time for revolution 0-1), y5−y4/(time for revolution 3-4), y8−y7/(time for revolution 6-7), and y11−y10/(time for revolution 9-10) would be the positive accelerations for the second curve 51. The positive accelerations for the first curve 50 is higher than for the second curve 51, and thus a change from one curve to the other and back due to a brief change of the A/F ratio would be caught by evaluating the temporary effect on this parameter.

It would also be possible to investigate other parameters that due to changes in the hysteresis around the cut out speed, and the invention should not be limited to the described examples.

When the A/F ratio has been optimized at cut-out speed, the A/F ratio at other speeds could be set by using engine mappings. At other speeds, other methods for optimizing the A/F ratio could also be used, for instance using the mapped A/F ratio as an input value in such methods.

The invention claimed is:

1. Method for controlling at least one of a fuel supply and an air supply to an internal combustion engine, in a fuel supply section thereof, such that an A/F-ratio is adjusted automatically to a desired level, the method comprising:

receiving engine speed data on rotational speed from the engine, detecting when the engine speed exceeds a predetermined threshold close to a cut-out speed threshold when the engine runs at full throttle without any load, responding to the detection of the engine speed exceeding the predetermined threshold by briefly changing the A/F ratio, comparing engine speed data that are essentially unaffected by the brief change to engine speed data that are affected by the brief change to evaluate the impact on the engine speed fluctuation resulting from the brief change, adjusting the A/F ratio in the same direction as the brief change if the engine speed data affected by the brief change indicates an increase in acceleration after combustion/s, and adjusting the A/F ratio in the opposite direction to the brief change if the engine speed data affected by the brief change indicates a decrease in acceleration after combustion/s.

2. Method according to claim 1 wherein the received engine speed data includes a sequence that includes a first portion and a last portion which are essentially unaffected by the brief change, and an intermediate portion, between the first and the last portion, which includes engine speed data that are affected by the brief change, the first and the last portion are used to determine an unaffected value of at least one parameter that is dependent on acceleration after combustion/s at least one affected value of said parameter is determined for the intermediate portion the impact on the engine speed fluctuation from the brief change is determined by subtracting the unaffected value from each affected value/s and calculating the sum of the resulting values/s if said sum is positive the A/F ratio is adjusted in the same direction as the brief change, and if said sum is negative the A/F ratio is adjusted in the opposite direction as the brief change.

3. Method according to claim 1 wherein the impact on period lengths of the engine speed fluctuation around the cut out speed threshold are evaluated, and wherein temporary increased period lengths are considered to correspond to a temporary increased acceleration after combustion/s, and wherein temporary decreased period lengths are considered to correspond to a temporary decreased acceleration after combustion/s.

4. Method according to claim 1 wherein the impact on amplitudes of the engine speed fluctuation around the cut out speed threshold are evaluated, and wherein temporary increased amplitudes are considered to correspond to a temporary increased acceleration after combustion/s, and wherein temporary decreased amplitudes are considered to correspond to a temporary decreased acceleration after combustion/s.

5. Method according to claim 1 wherein the impact on positive accelerations of the engine speed fluctuation around the cut out speed threshold are evaluated, and wherein temporary increased positive accelerations are considered to correspond to a temporary increased acceleration after combustions, and wherein temporary decreased positive accelerations are considered to correspond to a temporary decreased acceleration after combustion/s.

6. Method according to claim 1 wherein the brief change is affected by shutting off the fuel supply for a predetermined number of revolutions.

7. Method according to claim 1 wherein the engine speed is monitored one or several times per engine speed revolution.

8. A crank case scavenged internal combustion engine configured to employ control over at least one of a fuel supply and an air supply to the internal combustion engine, in a fuel supply section thereof, such that an A/F-ratio is adjusted automatically to a desired level, by performing operations including:

receiving engine speed data on rotational speed from the engine, detecting when the engine speed exceeds a predetermined threshold close to a cut-out speed threshold when the engine runs at full throttle without any load, responding to the detection of the engine speed exceeding the predetermined threshold by briefly changing the A/F ratio, comparing engine speed data that are essentially unaffected by the brief change to engine speed data that are affected by the brief change to evaluate the impact on the engine speed fluctuation resulting from the brief change, adjusting the A/F ratio in the same direction as the brief change if the engine speed data affected by the brief change indicates an increase in acceleration after combustion/s, and adjusting the A/F ratio in the opposite direction to the brief change if the engine speed data affected by the brief change indicates a decrease in acceleration after combustion/s.

9. The internal combustion engine according to claim 8 wherein the received engine speed data includes a sequence that includes a first portion and a last portion which are essentially unaffected by the brief change, and an intermediate portion, between the first and the last portion, which includes engine speed data that are affected by the brief change, the first and the last portion are used to determine an unaffected value of at least one parameter that is dependent on acceleration after combustion/s at least one affected value of said parameter is determined for the intermediate portion the impact on the engine speed fluctuation from the brief change is determined by subtracting the unaffected value from each affected value/s and calculating the sum of the resulting values/s if said sum is positive the A/F ratio is adjusted in the same direction as the brief change, and if said sum is negative the A/F ratio is adjusted in the opposite direction as the brief change.

10. The internal combustion engine according to claim 8 wherein the impact on period lengths of the engine speed fluctuation around the cut out speed threshold are evaluated, and wherein temporary increased period lengths are considered to correspond to a temporary increased acceleration after combustion/s, and wherein temporary decreased period lengths are considered to correspond to a temporary decreased acceleration after combustion/s.

11. The internal combustion engine according to claim 8 wherein the impact on amplitudes of the engine speed fluctuation around the cut out speed threshold are evaluated, and wherein temporary increased amplitudes are considered to correspond to a temporary increased acceleration after combustion/s, and wherein temporary decreased amplitudes are considered to correspond to a temporary decreased acceleration after combustion/s.

12. The internal combustion engine according to claim 8 wherein the impact on positive accelerations of the engine speed fluctuation around the cut out speed threshold are evaluated, and wherein temporary increased positive accelerations are considered to correspond to a temporary increased acceleration after combustions, and wherein temporary decreased positive accelerations are considered to correspond to a temporary decreased acceleration after combustion/s.

13. The internal combustion engine according to claim 8 wherein the brief change is affected by shutting off the fuel supply for a predetermined number of revolutions.

14. The internal combustion engine according to claim 8 wherein the engine speed is monitored one or several times per engine speed revolution.

* * * * *